US006975731B1

(12) United States Patent
Cohen et al.

(10) Patent No.: US 6,975,731 B1
(45) Date of Patent: Dec. 13, 2005

(54) SYSTEM FOR PRODUCING AN ARTIFICIAL SOUND ENVIRONMENT

(75) Inventors: Yuval Cohen, Rehovot (IL); Amir Bar On, Rehovot (IL); Giora Naveh, Rehovot (IL)

(73) Assignee: Beh Ltd., Rehovot (IL)

( * ) Notice: Subject to any disclaimer, the term of this patent is extended or adjusted under 35 U.S.C. 154(b) by 0 days.

(21) Appl. No.: 09/446,738

(22) PCT Filed: Jun. 24, 1998

(86) PCT No.: PCT/IL98/00297

§ 371 (c)(1),
(2), (4) Date: Feb. 18, 2000

(87) PCT Pub. No.: WO98/59525

PCT Pub. Date: Dec. 30, 1998

(30) Foreign Application Priority Data

Jun. 24, 1997 (IL) ..... 121155

(51) Int. Cl.[7] ..... H04R 5/02; H04R 5/00; H04R 25/00

(52) U.S. Cl. ..... 381/74; 381/310; 381/311; 381/384; 381/26

(58) Field of Search ..... 381/311, 310, 309, 381/307, 74, 384, 26, 79; 700/94; 455/3.06

(56) References Cited

U.S. PATENT DOCUMENTS

| | | | | |
|---|---|---|---|---|
| 4,068,093 | A * | 1/1978 | Fidi | 381/17 |
| 5,033,086 | A * | 7/1991 | Fidi | 381/310 |
| 5,181,248 | A | 1/1993 | Inanaga et al. | |
| 5,255,326 | A | 10/1993 | Stevenson | 381/110 |
| 5,386,478 | A | 1/1995 | Plunkett | 381/103 |
| 5,452,359 | A | 9/1995 | Inanaga et al. | |
| 5,459,790 | A * | 10/1995 | Scofield et al. | 381/310 |
| 5,495,534 | A | 2/1996 | Inanaga et al. | |
| 5,687,239 | A * | 11/1997 | Inanaga et al. | 381/309 |
| 6,009,179 | A * | 12/1999 | Wood et al. | 381/17 |

FOREIGN PATENT DOCUMENTS

| | | | |
|---|---|---|---|
| DE | 26 52 101 | 5/1978 | |
| DE | 2652101 A1 * | 5/1978 | H04R 5/00 |

(Continued)

OTHER PUBLICATIONS

Abstract of JP 09-238390, Patent Abstracts of Japan, 1997.

(Continued)

*Primary Examiner*—Vivian Chin
*Assistant Examiner*—Andrew Graham
(74) *Attorney, Agent, or Firm*—Ladas & Parry LLP

(57) ABSTRACT

A method for simulating an artificial sound environment including sending an ultrasound reference signal to a headphone assembly worn by a user having two ears, the headphone assembly audibly providing at least one audio signal to each of the ears, processing arrival times of the ultrasound reference signal at each ear, so as to measure a phase difference of the signal as perceived by one ear in contrast to the other ear, modulating at least two audio signals, at least one signal for each ear, in accordance with the phase difference, and sending the at least two audio signals via the headphone assembly to each of the ears.

3 Claims, 13 Drawing Sheets

FOREIGN PATENT DOCUMENTS

| | | | | |
|---|---|---|---|---|
| DE | 43 32 504 | A1 | 3/1995 | |
| EP | 0 100 153 | A | 2/1984 | |
| EP | 0 438 281 | A2 | 7/1991 | |
| EP | 0 438 281 | A3 | 7/1991 | |
| EP | 0438281 | A2 * | 7/1991 | ..... H04S 1/00 |
| EP | 0 705 053 | A2 | 4/1996 | |
| EP | 0 438 281 | B1 | 7/1996 | |
| FR | 2 237 386 | | 2/1975 | |
| JP | 42-227 | | 1/1942 | |
| JP | 54-19242 | | 7/1979 | |
| JP | 61-232795 | * | 10/1986 | ..... H04R 5/033 |
| JP | 09-238390 | | 9/1997 | |

OTHER PUBLICATIONS

European Examination Report for the corresponding European Patent Application No. 98928514.3, issued on Feb. 20, 2001 (2 pages).

Response to European Examination Report for the corresponding European Patent Application No. 98928514.3, sent by facsimile on Aug. 20, 2001 (5 pages).

European Refusal of Decision for the corresponding European Patent Application No. 98928514.3, issued on Oct. 13, 2003 (9 pages).

* cited by examiner 26
26
$C_{FL}$
$C_{FR}$
$C_{FL}$
$C_{FR}$
34
34
32
32
AMPLITUDE
TIME
LEFT EAR
RIGHT EAR
$C_{FL}$
$C_{FR}$
$t_r$
$t_l$
$t_r + \frac{DR}{V}$
$t_l + \frac{DR}{V}$
$t_r + \frac{DR}{V} = t_l + \frac{DL}{V}$

SYSTEM FOR PRODUCING AN ARTIFICIAL SOUND ENVIRONMENT

FIELD OF THE INVENTION

The present invention relates to the field of headphones for the provision of surround sound in audio reproduction systems.

BACKGROUND OF THE INVENTION

The capabilities of the simple Hi-Fi stereo system have been extended recently to incorporate the surround sound effects required by home theater systems. Such systems include a large-screen television receiver or video cassette player, four additional speakers, and a surround amplifier. The new system dramatically improves the immersion of the viewer in the sound effects of the movie.

A typical home theater system combines video capabilities with advanced audio systems, and it is based on the following major components:

1. A large screen TV receiver or video projector.
2. A laser disk player or a Hi-Fi video cassette player, which is the source of the audio and video signals. The audio track recorded on the film is not an ordinary stereo track. It encrypts additional information about the sound channels. The encryption protocols have evolved over the years. There are three major standards currently in use:
   a. Dolby ProLogic Surround in which in addition to the standard left and right channels, a center channel and a rear channel are recorded on the sound track. All channels are analog.
   b. THX, manufactured by the Lucas film company, in which two separate rear channels are used instead of one. All channels are analog.
   c. AC-3, the latest development by Dolby lab, in which six channels of music are digitally recorded on the sound track—front right, front left, center, rear right, rear left and subwoofer. The latter is not a full spectrum channel, as only one octave is necessary.
3. A surround amplifier, for extracting the surround channels from the incoming signal. Surround amplifiers are typically based on the Dolby chip. Most amplifiers have DSP (Digital Signal Processor) capabilities, which can modify the sound of a non-surround music source to sound as if it originates from different artificial acoustic environments, such as a concert hall, a theater, a jazz club, etc.
4. Speakers. A full surround system requires six different speakers, which must be of high quality to ensure realistic reproduction. Their function is as follows:
   a. Two main speakers, which reproduce most of the sound and music effect.
   b. One center speaker, located above or below the screen. This speaker is dedicated to the actors' voices.
   c. Two rear speakers, responsible for the special effects generated by the surround sound system, and for the artificial echo effects generated in the different DSP modes of the surround amplifier.
   d. A subwoofer, for reproducing all low frequency sounds, such as explosions. Location of the subwoofer is not critical, as this channel contains little directional information. Furthermore, such low frequency sound waves are felt by many parts of the body, and not specifically by the ears. The subwoofer is usually placed in the front field.

The room itself has to be modified to fit the home theater requirements:

a. Since there are six different sound sources in the room, any unwanted echo destroys the sound quality and directionality. The room must therefore be covered with acoustically absorbing materials, such as carpets and drapes.
b. Acoustical isolating materials must be used to avoid disturbing neighbors.
c. Wiring to the various speakers must be installed in the room, preferably without being a visual eyesore.

Each of the system elements affects the overall sound quality. The most important factor is the room acoustics. If the room is big and the walls bare, the echo severely affects the sound. The quality of the speakers is also a major element of the system. High performance speakers are large and expensive, but essential for good sound. Finally, the high power, low distortion amplifiers required for realistic surround sound are expensive.

These requirements make high quality surround sound systems very expensive both to purchase and to install in the home.

In order to provide high quality audio reproduction at low cost and at a personal level of listening, conventional Hi Fi audio systems have for a long time made use of stereo headphones. Attempts to utilize headphones to provide surround sound have been made by a number of manufacturers with limited success. In order to appreciate the problems involved in achieving an effective implementation of surround sound headphone technology, it is necessary to understand the physiological effects used by humans in experiencing three dimensional hearing.

In order to recognize the direction of a sound, the brain combines information received by the two ears and uses several psycho-acoustic effects to achieve a 3-D sensation of the surrounding world, as follows:

1. Phase difference: The sound does not reach both ears in the same phase—the ear closer to the sound source hears the sound first. By calculating the minute differences in time of arrival of the sound at the two ears (<1 msec.), the brain can detect the origin of the sound.
2 Level difference: The ear closer to the sound source hears a louder sound. This information is converted by the brain into directional and range information.
3. Head rotation: If, for example, the sound source is directly in front of or directly behind the listener, the phase and level difference between the two ears is zero. The body executes small, almost unnoticeable head movements in order to identify the origin of a sound. Even the smallest movement creates phase differences significant enough for the brain to discern the orientation of the source.
4. Doppler pitch difference: During head rotation, the sound pitch changes due to the Doppler effect. The ear which rotates towards the source hears a slightly higher pitch than the other one. The brain is capable of detecting this slight change in pitch, and decoding the source direction from this information.
5. Face blockage: While rotating the head away from the sound source, at a certain angle, the listener's head causes one ear to move into the "acoustical shade area" from the sound source, and the sound level in this ear becomes lower than in the other one. The brain uses this effect to locate the sound origin point.

The first three effects are the most important, but in order to get a perfect illusion, all five have to be reproduced correctly. When surround sound is produced by an array of speakers, the sound field produced is very similar to that present in real life, and the human brain is able to make use of all five of the above effects to appreciate the sound.

The use of headphones, however, effectively eliminates all five of the above effects present in free space propagation, since the sound originates from highly localized transducers close to the listener's ears. As the listener moves or turns his head the headphones move together with the listener's head. The use of simple binaural audio signals do not therefore give a perception of realism, since the sound field moves with the listener's head. In order to create a true surround sound effect, the audio signal supplied to the headphones must be coded in a sophisticated manner in order to simulate all five of the above psycho-acoustic effects as the listener moves while listening to the performance or the film.

Japanese Unexamined Patent Publication No. Sho 42-227 and Japanese Examined Patent Publication No. 54-19242 describe a surround sound headphone system including a gyro compass or a magnetic needle compass installed on the headphones to measure head movement and to transmit information about head position to a microprocessor. This microprocessor modifies the sound track signal according to the head angle, and transmits the modified signal back to the headphones, so that the listener experiences a surround sound effect. Such a system, using a gyroscope mounted in the headphones, has been marketed by the Sony Corporation. In U.S. Pat. No. 5,181,248 (corresponding to EP 438281), U.S. Pat. Nos. 5,452,359 and 5,495,534, a further development of this system is described in which the gyroscope is replaced by an ultrasonic ranging system. The angular location of the head is obtained from relative time-of-arrival measurements of an ultrasonic reference signal emitted by a transmitter located in front of the listener, by means of ultrasonic detectors located in the left and right arms of the headphone set. As previously, a microprocessor modifies the sound track signal according to the measured head angle and transmits the modified signal back to the headphones, so that the listener experiences a surround sound effect.

In a further system, developed by Virtual Listening Systems Inc. and described in *Stereo Review*, p. 38 (April 1997), head movements are ignored completely. The surround sound effects from typical audio situations are pre-programmed by algorithms which provide the phase shifts and volume changes corresponding to various situations. This system therefore simulates the surround sound effect by digital processing means.

German Patent 26 52 101 discloses a device with wireless transmission of a sound signal to a headphone by means of a transmitted carrier. Two reception elements are attached to the pair of headphones so as to afford directing characteristics close to that of human hearing.

European Patent Application No. EP 705053 describes a headphone for surround sound effect having two earphone members, each being provided with at least two loudspeakers arranged facing and forward of, or adjacent to, the pinna of the listener's ear.

All of the above-mentioned prior art systems use advanced real-time signal processing to modify the audio signal information. But the speed of available processors is such that they are unable to process the signals effectively, and the subjective results are unsatisfactory for a number of reasons:

a. The systems deal, only with the main psycho-acoustic parameters affecting 3-D recognition, namely, the first two, or at best three, in the list above. They all ignore the other, usually neglected, yet important, effects of Doppler pitch change effect and face blockage.
b. The relatively slow signal sampling rate results in an unnatural "metallic sound".
c. The currently available real time computing used is not fast enough. If the listener turns his head too fast, the computing delay is clearly discerned and disturbing.
d. In both the above mentioned commercially marketed systems, RF is used for communication between the headphones and the processor. RF is prone to interference from external sources such as cellular phones, radio transmitters or even a second headphone system nearby. Conversely, RF can interfere with other such systems.
e. The processor can only deal with one set of headphones. In order for a second listener to enjoy the movie, a complete second system needs to be purchased.
f. Because of the complexity of the systems, they are expensive.

Therefore, it would be desirable to provide a headphone surround sound system which overcomes the disadvantages of the prior art technology, in that:

a. It takes into consideration all five physiological aspects of 3-D sound appreciation, to provide perfect surround illusion;
b. It provides excellent sound quality, without any hesitation or metallic-sounding effects;
c. It is useable by several listeners, each listener requiring only a separate pair of headphones, all being controlled by one processing unit;
d. It is reasonably priced, and
e. It does not use interference-prone RF communication channels.

SUMMARY OF THE INVENTION

The present invention seeks to provide an improved headphone surround sound system.

There is thus provided in accordance with a preferred embodiment of the present invention a set of headphones, having earpieces each of which is equipped with an ultrasound detector for picking up the modulated audio signal information on an ultrasound wave transmitted into the listening area from an ultrasound transmitter, above-mentioned information being derived from the processing and modulating of an audio signal, so as to simulate the effects of surround sound. The processing and modulating of the audio signal is executed by an array of delay lines and modulators, connected and constructed such as to code the audio signal inputted to the earpieces with a simulation of the physiological effects that would be felt when listening to the audio signal propagated in free space.

It is noted that throughout the specification and claims, the term "headphone" encompasses not only headphones, but also any other apparatus for listening via the ears, such as a virtual reality helmet, for example.

There is also provided in accordance with another preferred embodiment of the present invention, a wireless headphone assembly including at least one ultrasound receiver for receiving at least one ultrasound signal along at least one ultrasound channel, and at least one transducer for converting each of the at least one ultrasound signal along the at least one ultrasound channel to a human audible signal.

Additionally, there is provided in accordance with yet another preferred embodiment of the present invention, a wireless headphone assembly wherein said at least one ultrasound receiver includes two ultrasound receivers, each of which receives an ultrasound signal along two ultrasound channels.

There is further provided in accordance with still another preferred embodiment of the present invention, a wireless headphone assembly wherein the at least one ultrasound receiver includes four ultrasound receivers, each of which receives an ultrasound signal along one ultrasound channel.

There is also provided in accordance with yet another preferred embodiment of the present invention, a wireless headphone assembly and wherein the at least one transducer includes at least one first transducer which converts the at least one ultrasound signal to at least one modulated electrical signal and at least one second transducer which converts the at least one modulated electrical signal to a human audible signal.

In addition, there is provided in accordance with another preferred embodiment of the present invention, a wireless headphone assembly and wherein at least one transducer comprises at least one multichannel transducer.

There is also provided in accordance with yet another preferred embodiment of the present invention, a wireless headphone assembly including at least one band pass filter associated with each ultrasound channel.

There is further provided in accordance with still another preferred embodiment of the present invention, a wireless headphone assembly including at least one demodulator associated with each ultrasound channel.

In addition, there is provided in accordance with a further preferred embodiment of the present invention, a wireless headphone assembly and wherein the at least one first transducer operative to convert the at least one ultrasound signal to at least one modulated electrical signal, includes at least two first transducers, each arranged to be located adjacent to a different ear of a user.

There is further provided in accordance with yet another preferred embodiment of the present invention a wireless headphone assembly wherein the at least one second transducer includes at least two transducers, each providing a human audible output to a different ear of a user.

In addition, there is provided in accordance with another preferred embodiment of the present invention, a wireless headphone assembly wherein a human audible signal derived from ultrasound signals received at each of the at least two ultrasound receivers is supplied to each ear of a user.

There is also provided in accordance with yet another preferred embodiment of the present invention, a wireless headphone assembly and wherein the at least two ultrasound receivers each receive ultrasound signals along at least two ultrasonic channels, the at least two transducers convert ultrasound signals along at least two human audible channels to human audible signals, and information received along each one of the at least two channels of each of the at least two ultrasound receivers is supplied to each of two different ears of the user along a separate one of the human audible channels.

There is further provided in accordance with still another preferred embodiment of the present invention, a wireless headphone assembly including delay lines operative to simulate the acoustic delay occurring between the arrival of sound from at least one signal source at different ears of the user.

In addition, there is provided in accordance with yet another preferred embodiment of the present invention, a headphone system providing a simulated multi-source sound environment including at least one wireless headphone assembly which may be worn by a user and which includes at least one ultrasound receiver for receiving at least one ultrasound signal along at least one ultrasound channel and at least one transducer for converting each of the at least one ultrasound signal along the at least one ultrasound channel to a human audible signal, and at least one processor receiving a multi-source signal and modulating the sound carrier along the plurality of channels in accordance with the multi-source signal, and at least one transmitter for transmitting the modulated sound carrier to the pair of headphones along a plurality of channels.

In addition, there is provided in accordance with vet another preferred embodiment of the present invention, a headphone system wherein the use of ultrasound for transmitting the modulated carrier to the at least one headphone is operative to cause a listener using the headphone to experience the psycho-acoustic effects that he would experience if the multi source signals were transmitted in free space as audible sound waves from suitably located sound sources.

There is further provided in accordance with yet another preferred embodiment of the present invention, a method for simulating an artificial sound environment including converting an audible signal to an ultrasound wave, receiving the ultrasound wave by means of a wireless headphone assembly, and converting the ultrasound wave to an audible signal by means of the wireless headphone assembly.

There is also provided in accordance with a preferred embodiment of the present invention a method for simulating an artificial sound environment including sending an ultrasound reference signal to a headphone assembly worn by a user having two ears, the headphone assembly audibly providing at least one audio signal to each of the ears, processing arrival times of the ultrasound reference signal at each the ear, so as to measure a phase difference of the signal as perceived by one the ear in contrast to the other ear, modulating at least two audio signals, at least one signal for each the ear, in accordance with the phase difference, and sending the at least two audio signals via the headphone assembly to each of the ears.

In accordance with a preferred embodiment of the present invention the method also includes sending the at least two audio signals and the ultrasound reference signal via an ultrasound carrier.

Further in accordance with a preferred embodiment of the present invention the step of sending the at least two audio signals includes sending the signals to the headphone assembly by wired communication.

Still further in accordance with a preferred embodiment of the present invention the step of sending the at least two audio signals includes sending the signals to the headphone assembly by wireless communication.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

A preferred embodiment of the present invention is described in the field of surround sound systems. However, it is appreciated that the present invention is readily applicable for use in other applications such as virtual reality systems, computer games, simulator systems, and the like.

Figure 1:
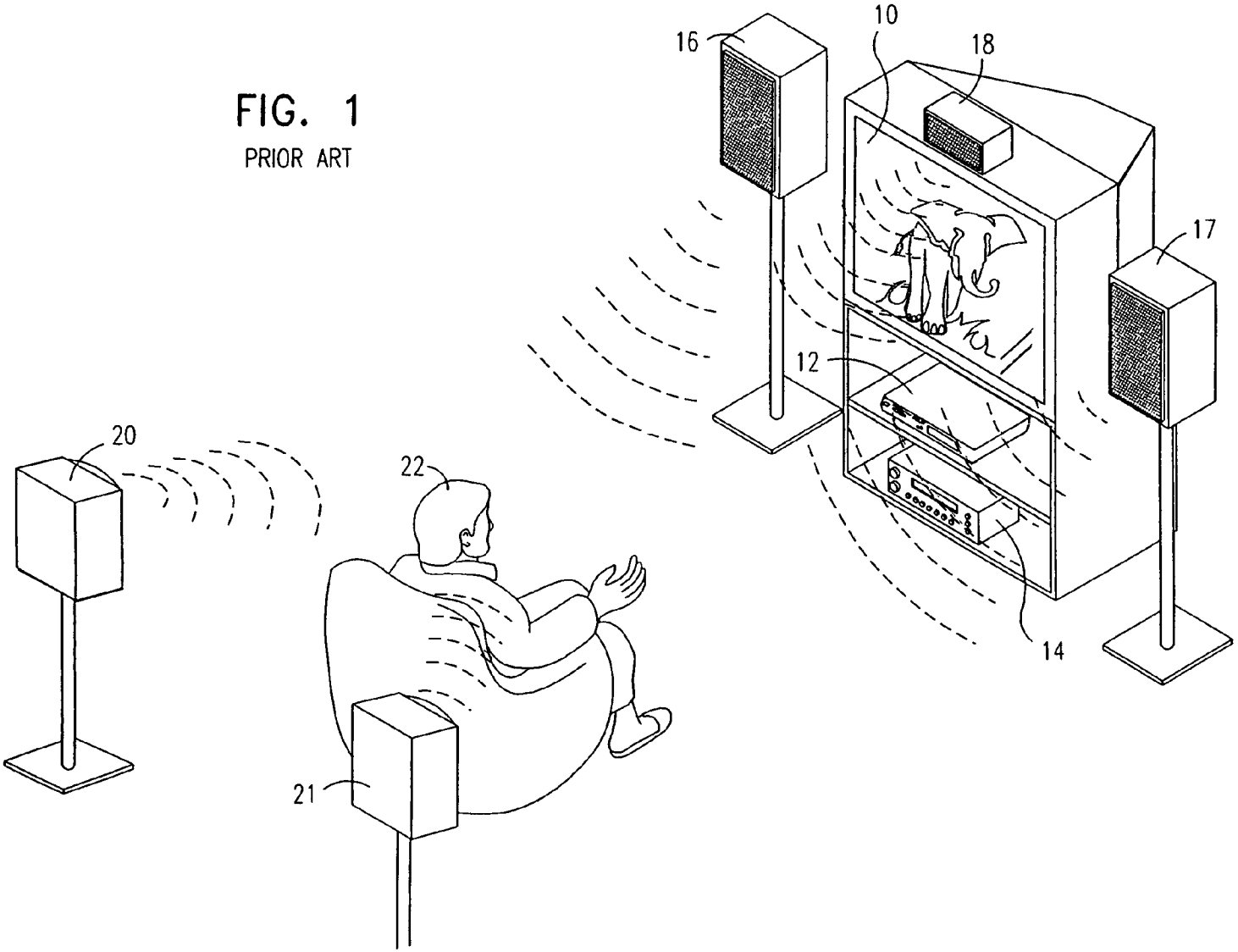
FIG. 1 PRIOR ART
FIG. 1 is a pictorial representation of a prior art conventional speaker-based surround sound system, showing the component parts and their mutual location.

Reference is now made to FIG. 1 which is a pictorial representation of a prior art conventional speaker-based surround sound system, as described in the "Background to the Invention", showing the component parts and their mutual location with respect to the listener. The parts shown are a TV receiver or video screen 10, an audio signal source 12, such as a laser disk player or video cassette player, the surround sound amplifier 14, the main speakers, namely the front left speaker 16 and the front right 17, the center speaker 18, the rear left speaker 20, and the rear right speaker 21. In this representation, only the five speakers which provide the directional information are shown. The sub-woofer is understood, and its location is not critical. The listener 22 is shown seated at the "sweet spot", the only area in the room where the surround sound effect is felt realistically.

Figure 2A:
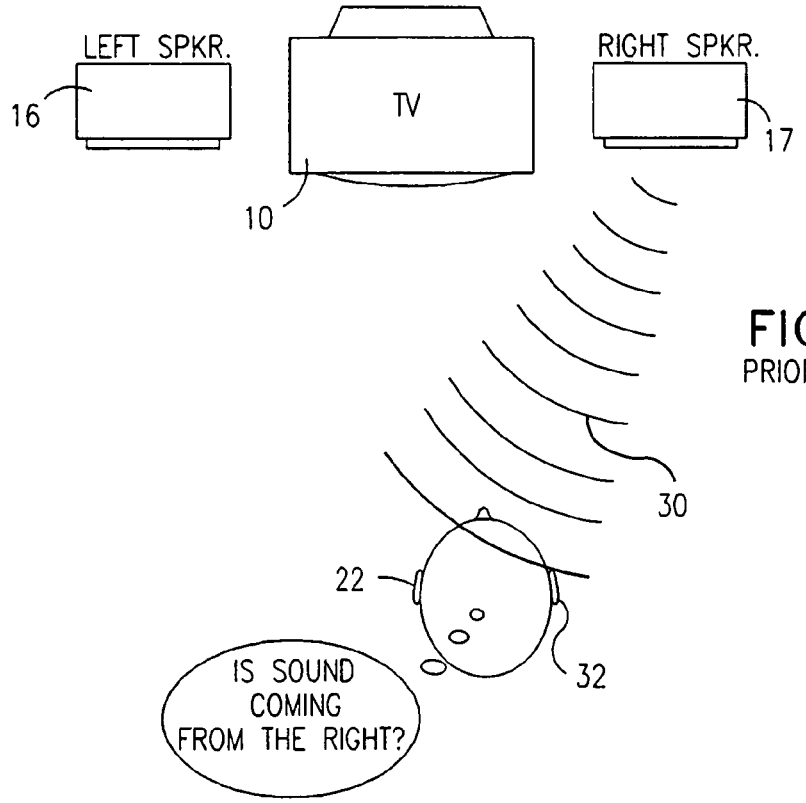
FIG.2A PRIOR ART
FIGS. 2A and 2B illustrate how, in the prior art conventional speaker-based surround sound system, the listener detects the direction from which a sound emanates by discerning the small time difference between receipt of the sound by the ear closer to the origin, and by that further from the origin.
Figure 2B:
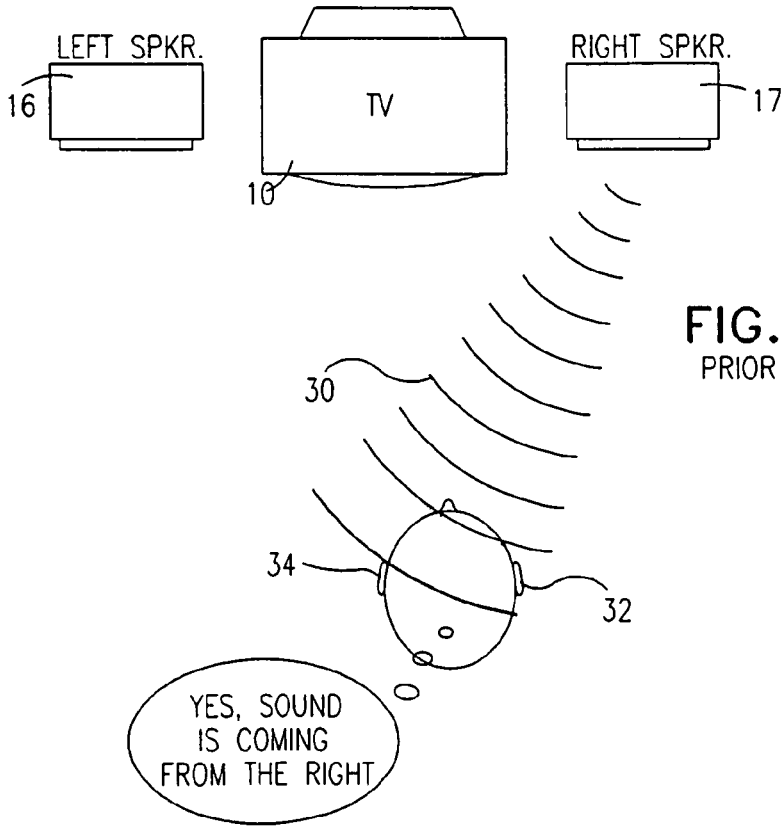
FIG.2B PRIOR ART

FIGS. 2A and 2B show how a listener 22 seated in front of a prior art speaker-based surround sound system is able to detect the direction from which a sound emanates by discerning the small time difference between receipt of the sound by the ear closer to the origin, and by that further from the origin. In FIG. 2A, a sound wave 30 coming from the right front speaker 17 is shown impinging first on the listener's right ear 32. In FIG. 2B, the sound is shown hitting his left ear 34 a short while later, typically 0.3 msec for a signal emanating 30' off axis.

Figure 3A:
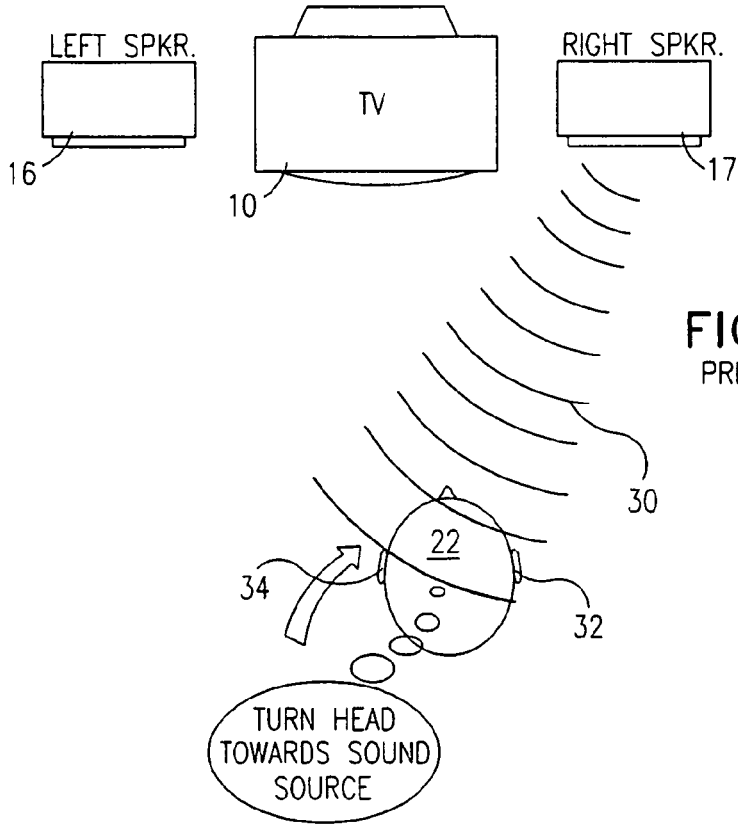
FIG.3A PRIOR ART
FIGS. 3A and 3B show how, in the prior art conventional speaker-based surround sound system, the listener detects the direction from which a sound emanates, and by rotating his head towards the sound origin, equalizes the phase of the sound heard by both ears.
Figure 3B:
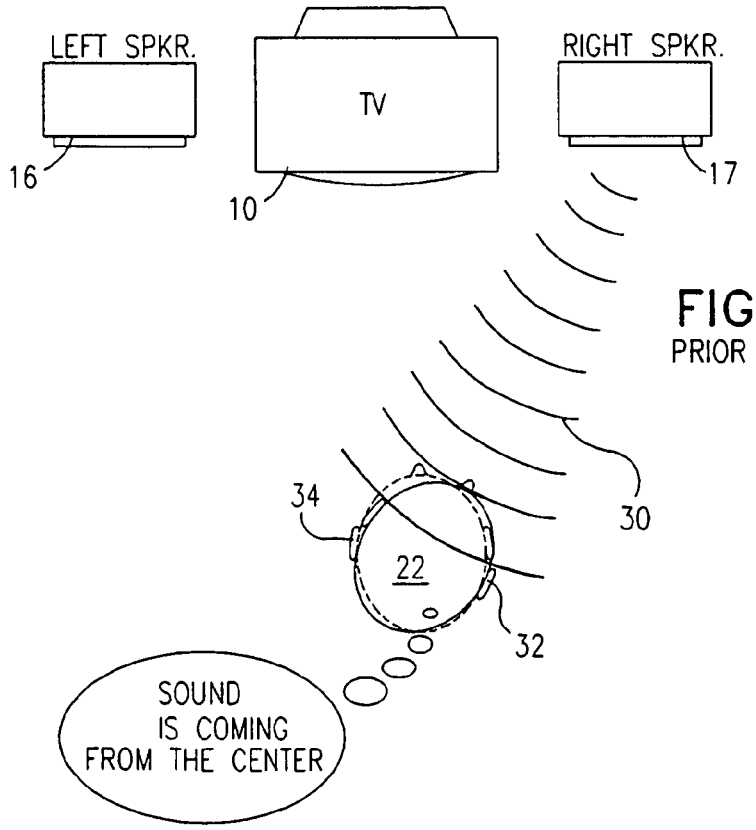
FIG.3B PRIOR ART

FIGS. 3A and 3B are illustrations of the method by which a listener 22 seated in front of a prior art speaker-based surround sound system detects the direction from which a sound emanates, and by rotating his head towards the sound origin, equalizes the phase of the sound heard by both ears.

In FIG. 3A, a sound wave 30 coming from the right front speaker 17 is shown impinging on the listener's ears, with a small time delay between the moment of impingement on the left ear as compared with the right ear. In FIG. 3B, the listener 22 has turned his head in the direction of the sound origin, and is able to detect this direction by mentally discerning when the sound is received by both ears at the same time.

Figures 4A, 4B:
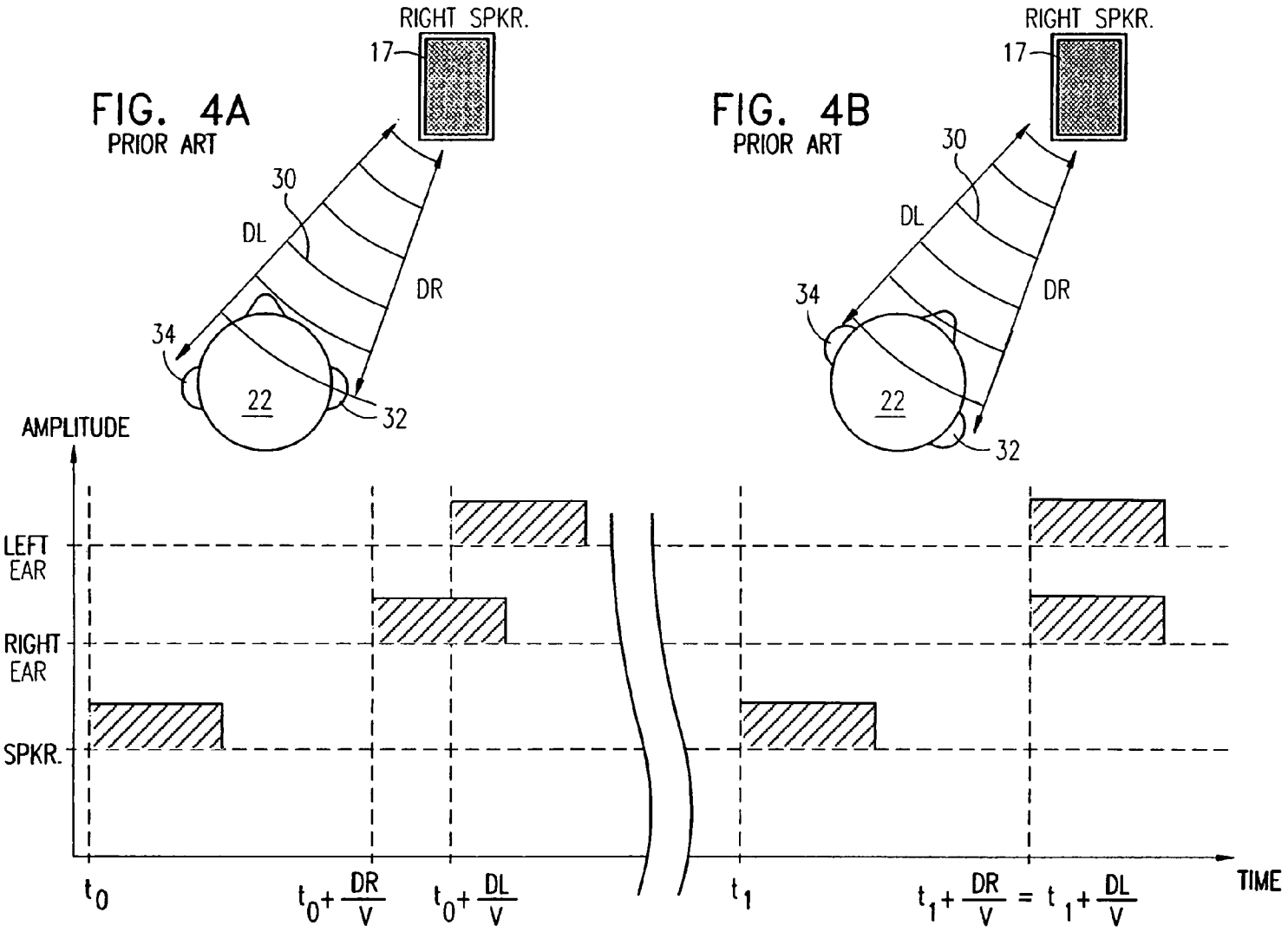
FIG. 4A PRIOR ART
FIG. 4B PRIOR ART
FIG. 4A and FIG. 4B present the timing sequence of the receipt of the sound by the left and right ears of a listener seated in front of a conventional prior art surround sound system, and how the timing sequence changes when he rotates his head towards the sound origin and equalizes the phase of the sound heard by both ears.

FIG. 4A shows a quantitative depiction of the timing sequences for FIGS. 2A and 2B, for the arrival of the sound at the left and right ears of a listener seated in front of a prior art surround sound system. The horizontal axis represents the time elapsed during the propagation of the sound waves. FIG. 4B shows the same timing sequences for the situation depicted in FIGS. 3A and 3B, where the listener turns his head towards the sound source.

In FIG. 4A, the sound wave is depicted leaving the speaker 17 at time $t_o$ and arriving at the listener's right ear after a time $t_o$+DR/V, where V is the velocity of the sound, and DR is the distance from the speaker to the right ear 32. The sound arrives at his left ear only after a time $t_o$+DL/V, where DL>DR. The listener's brain discerns this slight delay to locate the origin of the sound.

In FIG. 4B, the listener is shown after rotating his head towards the sound origin. The timing sequence shows how the sound wave leaves the speaker 17 at time $t_l$ and arrives at both of the listener's ears after a time $t_l$+DR/V, which is identical to $t_l$+DL/V, since the distance from the speaker to the two ears is equal.

Figure 5:
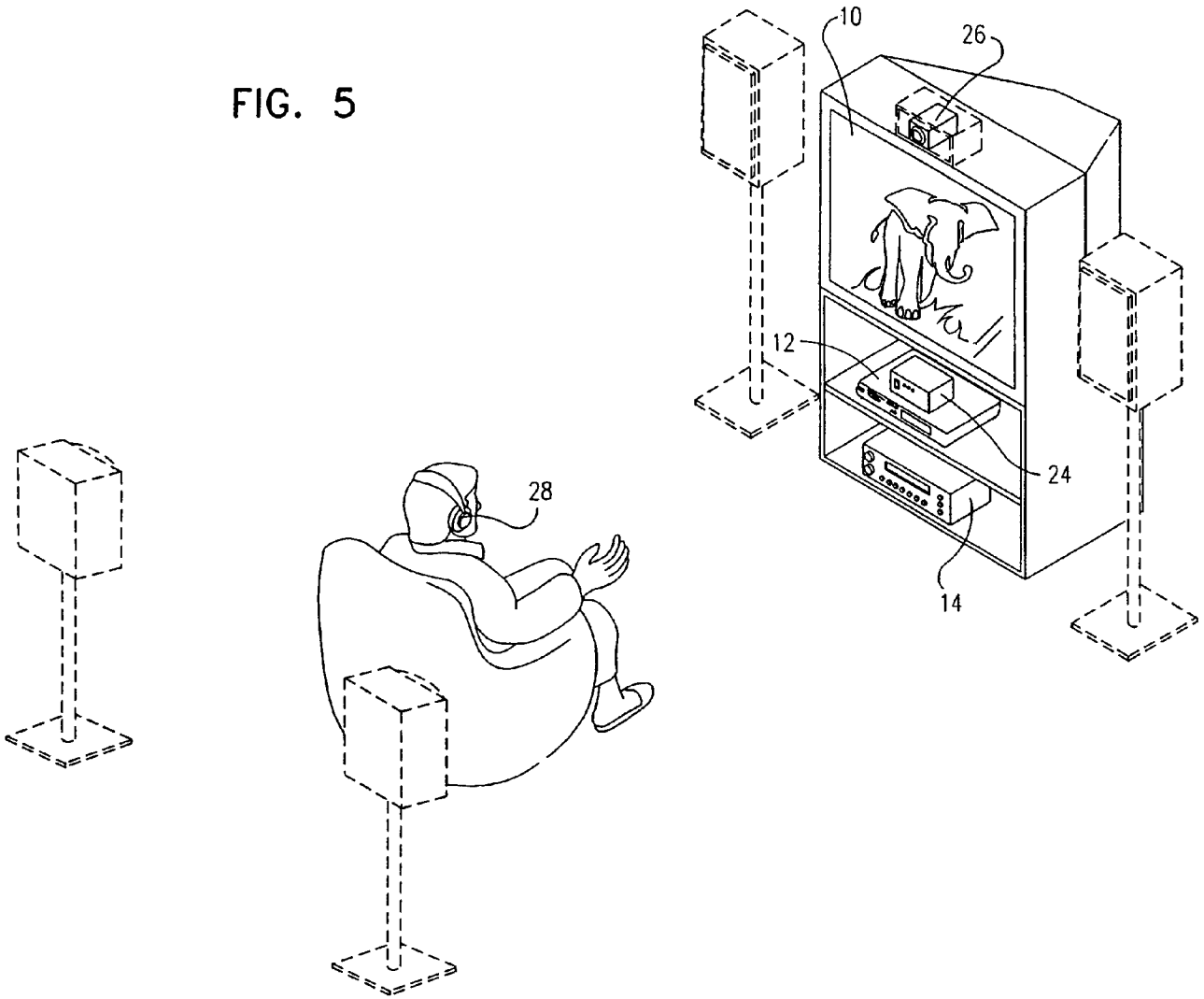
FIG. 5 is a pictorial representation of a headphone-based surround sound system constructed and operative in accordance with a preferred embodiment of the present invention.

A pictorial representation of a surround sound headphone system, constructed and operative in accordance with a preferred embodiment of the present invention, is shown in FIG. 5. It is seen that the five speakers shown in the conventional prior art system of FIG. 1 have been eliminated. In their place are three small-size components, which comprise the basic components of the headphone surround sound system. These components are a surround sound encoder 24, an ultrasound transducer 26, and a set of surround sound headphones 28.

The surround sound encoder 24 is provided with an input signal from the audio signal source 12—a laser disk player, a VCR, or any other stereo source. The unit can be connected to a surround sound amplifier 14, such as an external Dolby processor, or it can be fitted with its own internal surround processor. The encoder 24 processes the five conventional separated surround sound channels. The modified signal is then modulated, by AM or FM for example, and amplified to bring it to a sufficient level for transmission. The simulation of different sound sources is made by using four different carrier frequencies on one transmitted ultrasound beam. Two are used to simulate the front sound sources and two for the rear sources.

It is appreciated that even though the described embodiment of this invention is constructed and operative to handle signals coded according to the Dolby recording standard it can easily be adapted to any other 3-D sound recording standard.

The modulated and amplified signal is fed to the ultrasound transducer 26, mounted on top of the TV receiver, and transmitted into the listening room in the form of coded ultrasound waves containing the surround sound signals.

It is appreciated that even though the described embodiment of this invention is constructed and operative to convey all of the audio information by one transmitter, it can easily be adapted to transmit via several transmitters such as one for rear channels and one for front channels.

The surround sound headphones 28 worn by the listener contain two special microphones mounted on each ear-piece, which receive the ultrasound signals transmitted from on top of the TV monitor. Four decoders convert the signal into audio surround sound, which is then amplified and reproduced by the headphones' speakers. Each ear-piece is sensitive to two frequencies—one front and one rear.

The propagation effects of the above described system are now explained. Since ultrasound is a normal sound wave but of super-audible frequency, it propagates through air in exactly the same manner as any other sound wave. It is therefore the specific use of an ultrasound reference signal sent from the transmitter to the listener's head, which enables the surround sound effect produced by the present invention to behave exactly like the audio sound produced by a conventional free space surround sound system. (In the embodiment of FIG. 5, the ultrasound signal is not only used as the reference signal but also as the carrier signal for the audio information. In another preferred embodiment of the present invention, described hereinbelow with reference to FIGS. 12 and 13, the ultrasound signal acts only as the reference signal and the audio information is transmitted separately by wired or wireless communication.)

In particular, all the parameters affecting normal hearing are applicable to ultrasound with respect to the five psychoacoustic effects mentioned above:

1. The velocity of the ultrasound carrier generates an accurate phase difference between the listeners two ears.
2. The level of the ultrasound carrier causes the correct transduced sound volume differences between the two ears.
3. No special consideration need be given to measuring head movements. The ultrasound is affected by head movements exactly like audible sound signals.
4. The Doppler effect changes the pitch with head rotation in exactly the same way as if real speakers were being used.
5. Due to the location of the ultrasonic receivers on either side of the headphone arms, the face blockage effect is retained.

A further advantage of the use of ultrasound is that, unlike RF, the environment does not interfere with the transmission, giving rise to a noisy signal, nor does the transmission cause interference to the environment.

Figure 6:
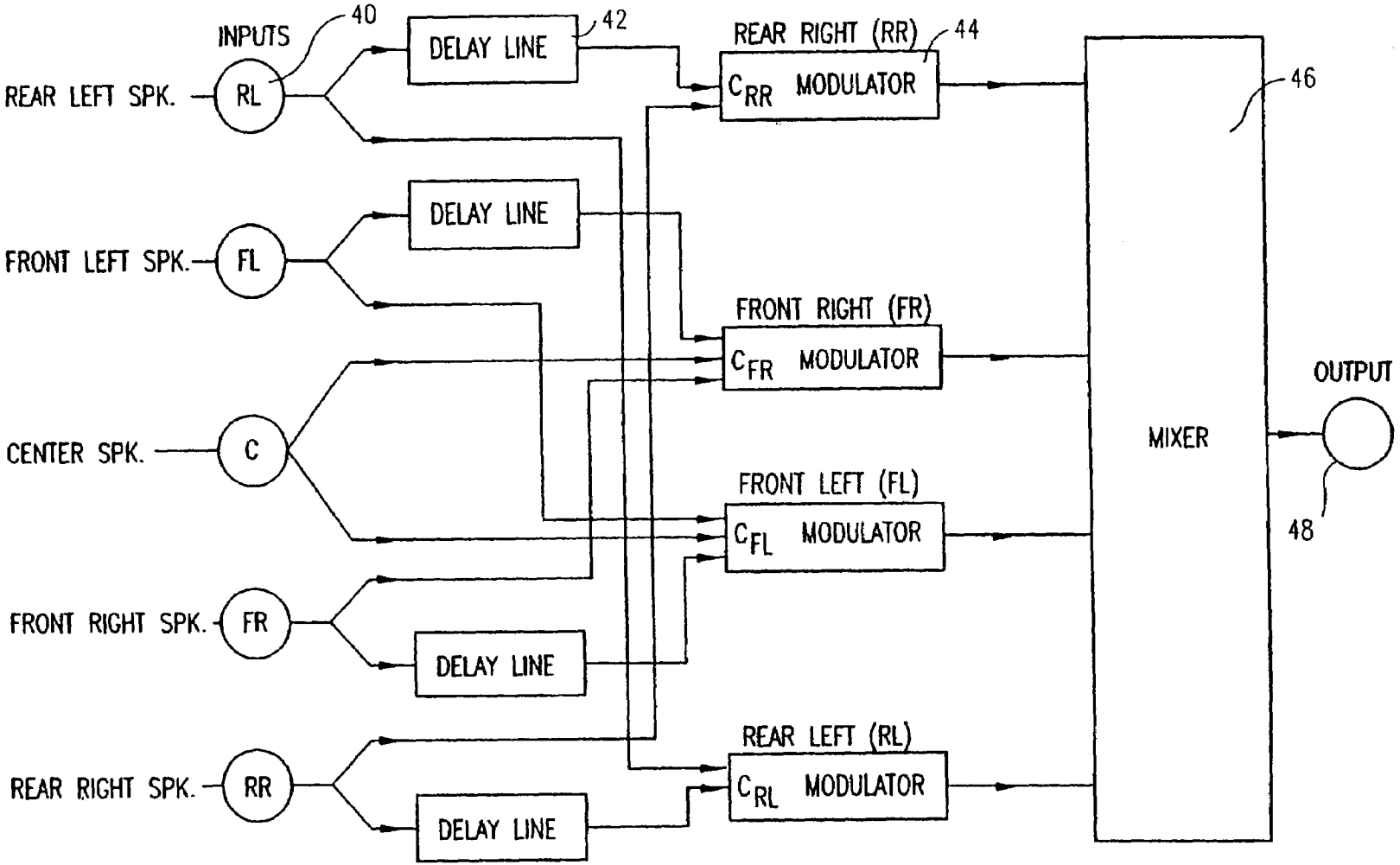
FIG. 6 is a block diagram of an encoder unit constructed and connected in accordance with a preferred embodiment of the present invention, showing how the five separate inputs from the surround sound audio signals are inputted through delay lines and modulators to provide the correct mixture of signals for outputting to the ultrasound transmitter.

FIG. 6 shows a schematic block diagram of the encoder unit. This unit modifies the signals from each of the five conventional surround sound input channels 40—front left, front right, center, rear left and rear right—by means of delay lines 42, operative on the signals according to their source channel and their destination channel. The resulting signal information is routed into four output channels—front left, front right, rear left and rear right—which are, for example, AM or FM modulated 44 onto four different carrier frequencies using a built-in local oscillator, and inputted to a mixer 46, whose output 48 is amplified for feeding to the ultrasound transducer.

The five different input channels are processed and connected in the following manner. The center channel signal is fed directly to the $C_{FL}$ and $C_{FR}$ modulators for transmission by the two front channel carriers—$C_{FL}$ and $C_{FR}$. The front right channel signal is fed in parallel to two channels—directly to the $C_{FR}$ channel modulator, and to the $C_{FL}$ modulator via a 0.3 msec. delay line (calculated for a sound source located 30° off center). The front left channel, in a manner similar to the right channel, is fed directly to the $C_{FL}$ channel modulator, and with a 0.3 msec. delay to the $C_{FR}$ modulator. The rear right channel signal is connected directly to the $C_{RR}$ modulator, and via a 0.3 msec delay line to $C_{RL}$. The rear left channel signal is connected directly to the $C_{RL}$ modulator, and via a 0.3 msec delay line to $C_{RR}$.

Figure 7:
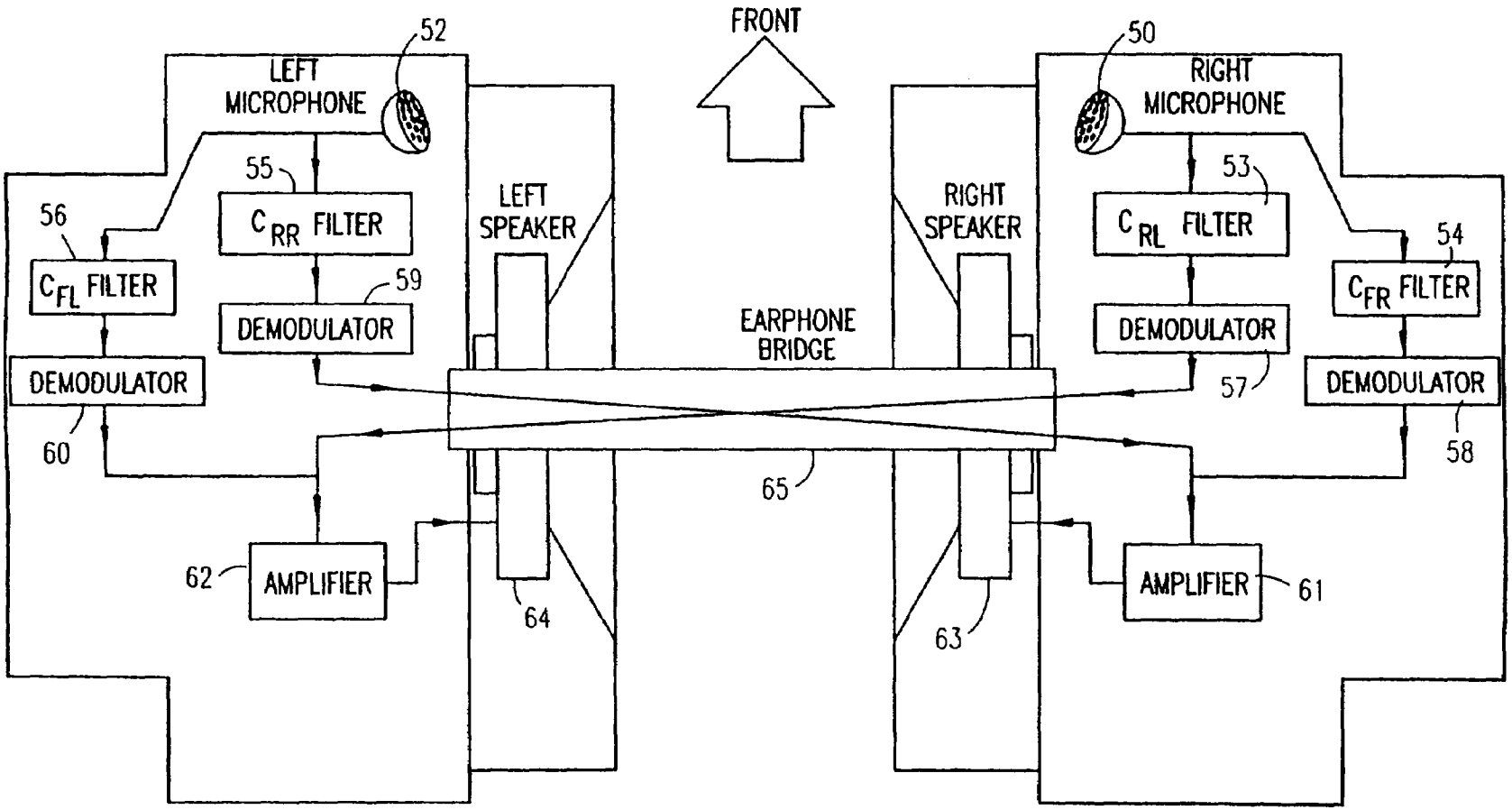
FIG. 7 is a schematic block diagram of a pair of headphones constructed and operative in accordance with a preferred embodiment of the present invention, showing the components and their interconnections required to receive, demodulate and convert the ultrasound signals emitted by the system transmitter, to audible signals to be perceived by the listener as surround sound.

In order to see how this method of encoding produces effective surround sound, it is necessary to understand how the decoding process is executed in the surround sound headphones. The construction of these headphones is shown in FIG. 7.

The headphones are based on standard Hi-Fi headphones equipped with additional electronic components, as follows: two ultrasound microphones 50 and 52, four filters 53, 54, 55 and 56, four demodulators 57, 58, 59 and 60, a pair of amplifiers 61 and 62. These amplifiers feed the speakers 63 and 64 of the headphones. The two ultrasound microphones 50, 52, are located one on each ear-piece, on either side of the earphone bridge 65, and act as receivers for the transmitted ultrasound signals. The signals from each of these microphones are filtered and demodulated to extract the two channels, front and rear, associated with each ear. The resulting signals are amplified and fed to each ear-piece's speaker, which transduce them to human audible signals.

Each microphone is connected to both ear-pieces as follows. The front carrier is connected directly to the ear-piece on the side on which the microphone is mounted, and the rear carrier to the opposite ear-piece. Specifically, for the front channels, the right microphone transmits $C_{FR}$ to the right ear and the left microphone transmits $C_{FL}$ to the left ear. For the rear channels, the connections are crossed such that the right microphone transmits $C_{RL}$ to the left ear and the left microphone transmits $C_{RR}$ to the right ear. Using this crossed-connection, any sound source in any direction can be simulated using only one ultrasonic transmission. In particular, rear sound sources are correctly simulated using one transmitter located in the front.

Figure 8A:
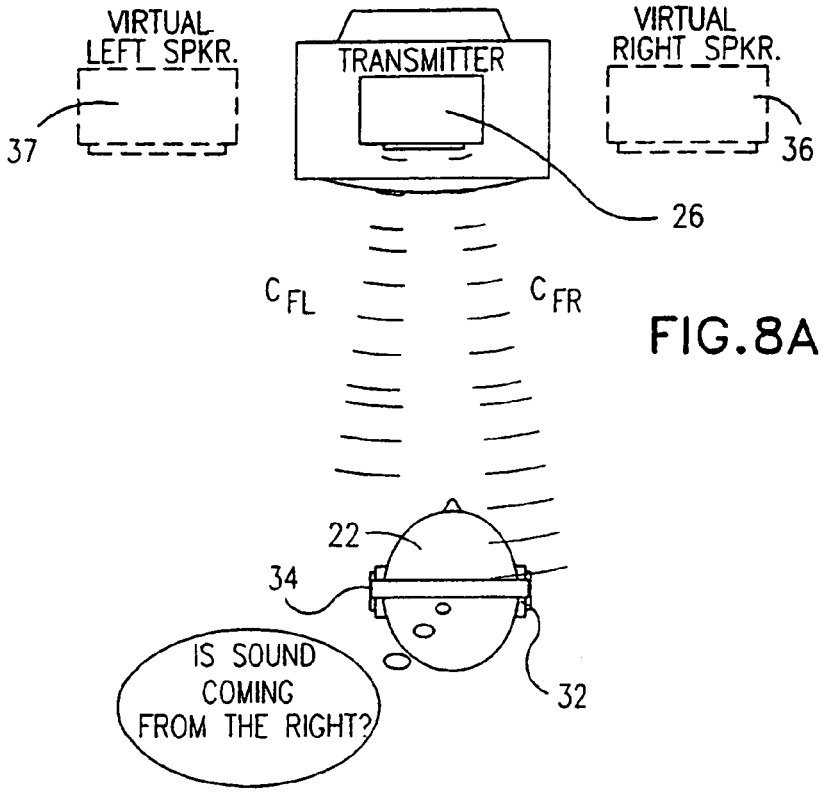
FIGS. 8A and 8B illustrate how a surround sound headphone system constructed and operative in accordance with a preferred embodiment of the present invention simulates the phase difference psycho-acoustic effect in order to enable the listener to detect the direction from which a sound emanates.
Figure 8B:
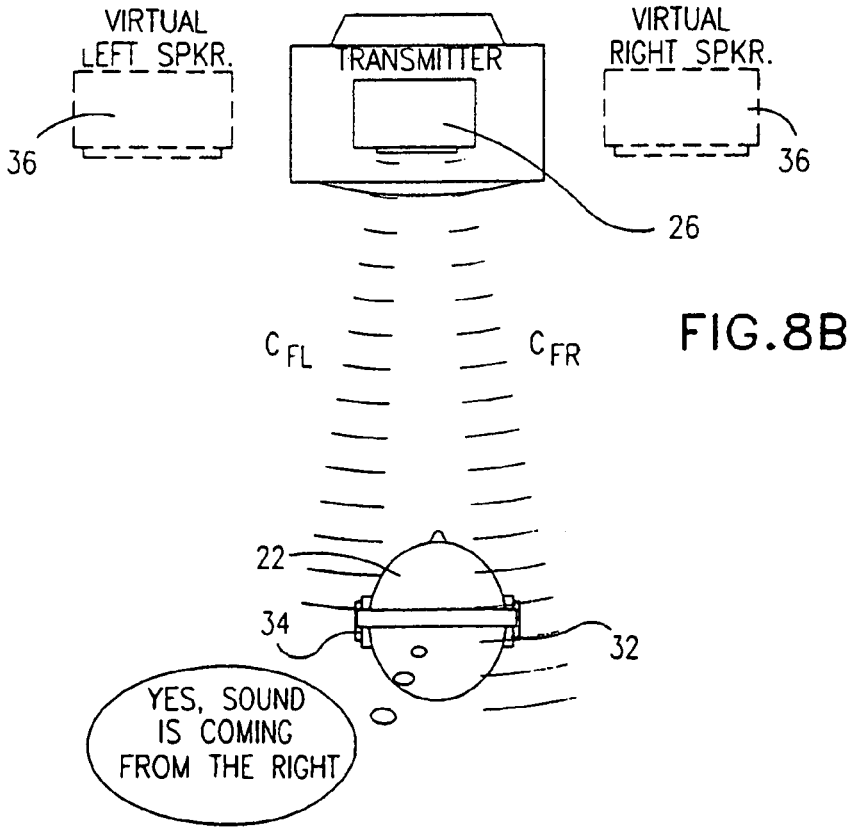

FIGS. 8A and 8B illustrate how a surround sound headphone system constructed and operative in accordance with a preferred embodiment of the present invention simulates the phase difference psycho-acoustic effect, enabling the listener 22 to detect the direction from which a sound seems to emanate. In FIG. 8A, two front channel signals $C_{FR}$ and $C_{FL}$ are sent out by the transmitter 26, but with a slight time delay between them. The $C_{FL}$ signal is delayed by about 0.3 msec comparing to $C_{FR}$. Because of the direct pickup and connection in the earphones, the listener 22 hears the sound first in his right ear 32, and only 0.3 millisecond later, as shown in FIG. 8B, in his left ear 34. It seems to the listener as if a virtual speaker 36 is located on his right side at about 30°.

Figure 9A:
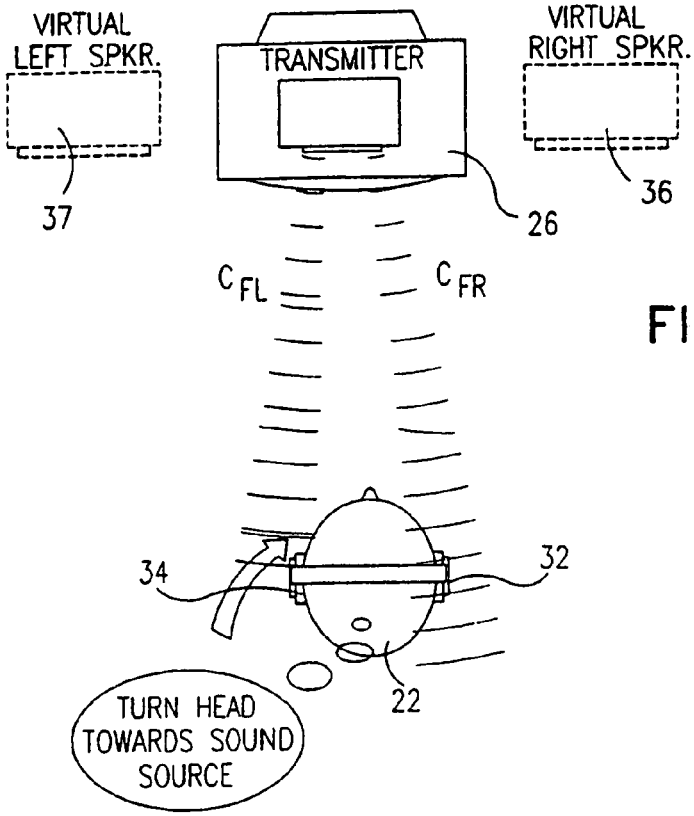
FIGS. 9A and 9B show how a surround sound headphone system constructed and operative in accordance with a preferred embodiment of the present invention simulates how the listener detects the direction from which a sound emanates, and by rotating his head towards the sound origin, equalizes the phase of the sound heard by both ears.
Figure 9B:
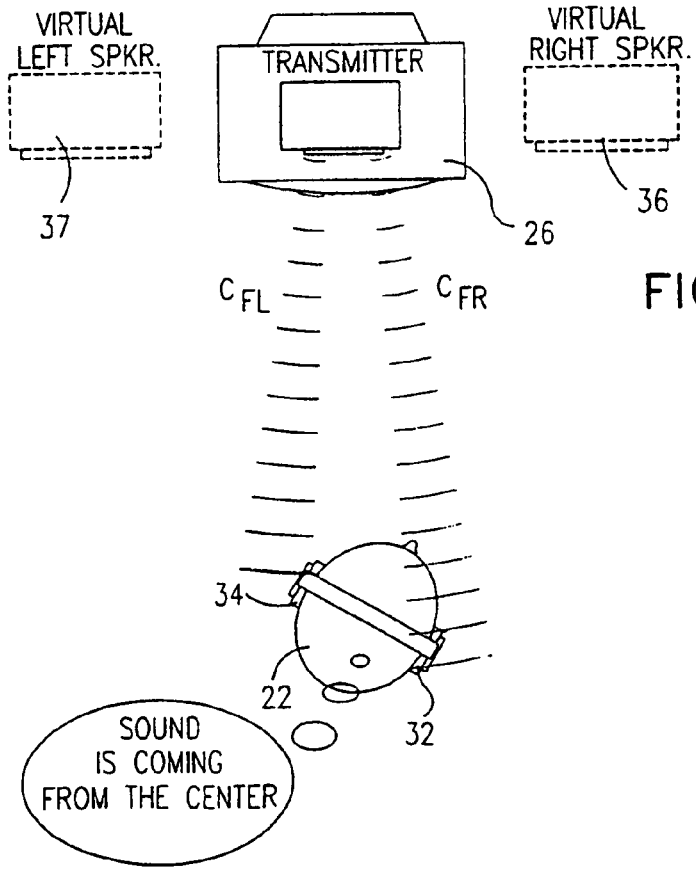

FIGS. 9A and 9B demonstrate how the surround sound headphone system enables the listener to detect the direction from which a sound emanates by rotating his head towards the sound origin in order to equalize the phase of the sound heard by both ears. The figure nomenclature is the same as in FIGS. 8A and 8B. If the listener rotates his head to the right, the delay between the signals $C_{FL}$ and $C_{FR}$ decrease until his head is turned 30° to the right. At this point, the delay is zero and the listener has the illusion of looking directly towards the origin of the sound, as illustrated in FIG. 9B.

Figures 10A, 10B:
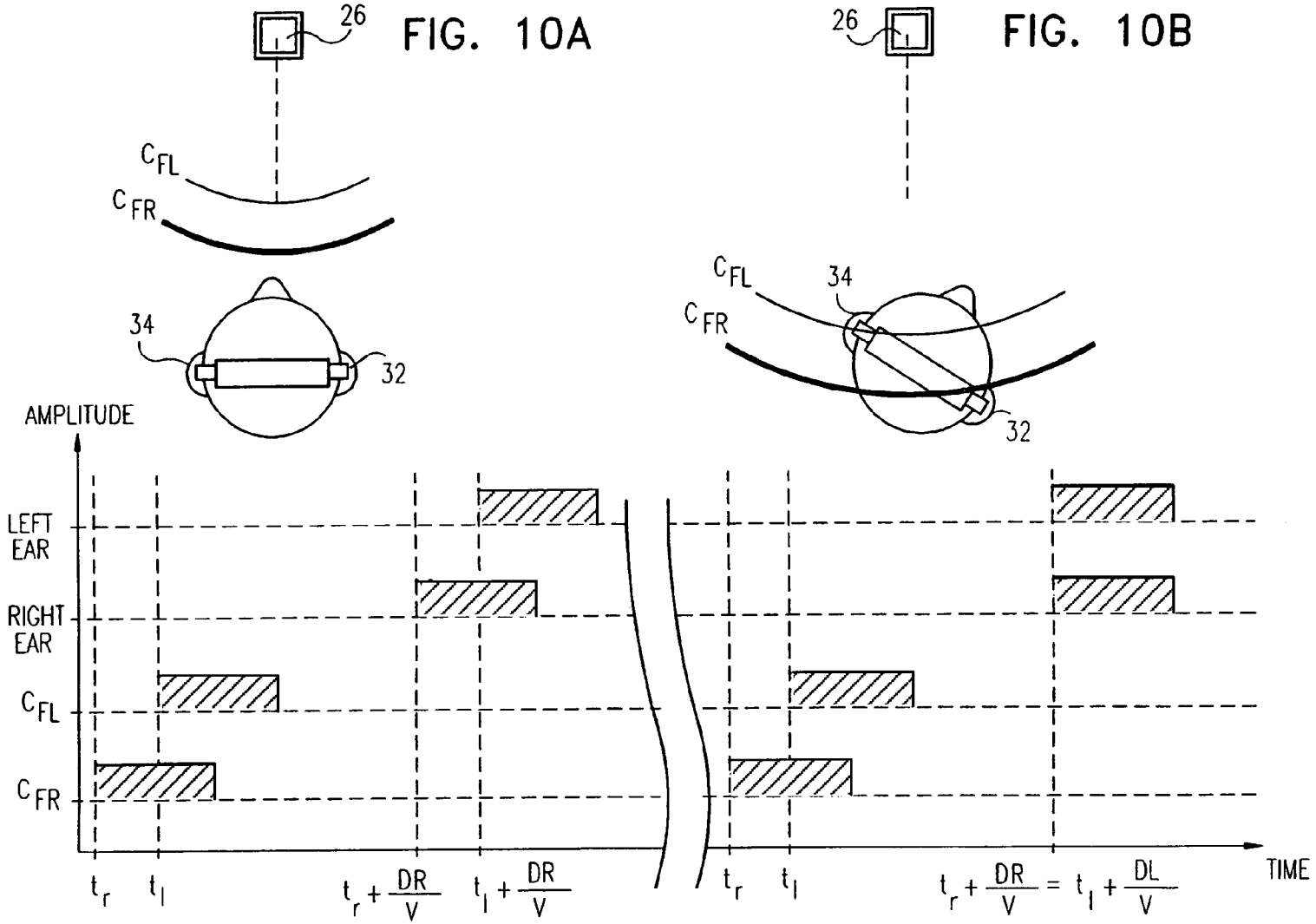
FIG. 10A and FIG. 10B illustrate the timing sequence of the receipt of the sound by the left and right ears of a listener using a surround sound headphone system constructed and operative in accordance with a preferred embodiment of the present invention, and shows how the timing sequence changes when he rotates his head towards his perception of the sound origin, and equalizes the phase of the sound heard by both his ears.

FIG. 10A shows a quantitative depiction of the timing sequences for FIGS. 8A and 8B, for the arrival of the sound at the left and right ears of a listener using a surround sound headphone system. The horizontal axis represents the time elapsed during the propagation of the sound signals. FIG. 10B shows the same timing sequences for the situation depicted in FIGS. 9A and 9B, where the listener turns his head towards the sound source.

In FIG. 10A, the front right signal $C_{FR}$ leaves the transmitter 26, at time $t_r$ and arrives at the listener's right ear after a time $t_r$+DR/V, where V is the velocity of the sound, and DR is the distance from the transmitter to the right ear 32. The front left signal $C_{FL}$ leaves the transmitter 26, at time $t_l$ and arrives at the listener's left ear after a time $t_l$+DL/V. Since DR=DL when the listener is looking forward, the sound arrives at his left ear a time $t_l$−$t_r$ later than at his right ear, and the listener's brain discerns this slight delay to locate the origin of the sound as if it were to the right of him at about 30°.

In FIG. 10B, the listener is shown after rotating his head towards the sound origin in an attempt to localize its direction. The timing sequence shows how, even though they were transmitted a time $t_l$−$t_r$ apart, the $C_{FR}$ and $C_{FL}$ signals both seem to arrive at the listener's ears at the same moment, after a time $t_r$+DR/V, equal to $t_l$+DL/V, and give the listener the illusion as if they originated from the direction towards which he turned his head, namely his front right hand side at about 30°.

The reason for the crossed connection for the rear channels in the headphones is now clear. If a real sound source is located in front of the listener, by turning his head to the right for example, his right ear moves further from the source, while his left ear moves closer to it. If on the other hand, the source is located behind him, the effect is opposite, in that by turning his head to the right, for example, his right ear moves closer to the source, while his left ear moves further from it. Thus, sources located behind the listener behave as if they were left-to-right reversed in comparison to those in front of him. The headphones implement this effect by crossing over the rear connections as shown in FIG. 7.

Figure 11:
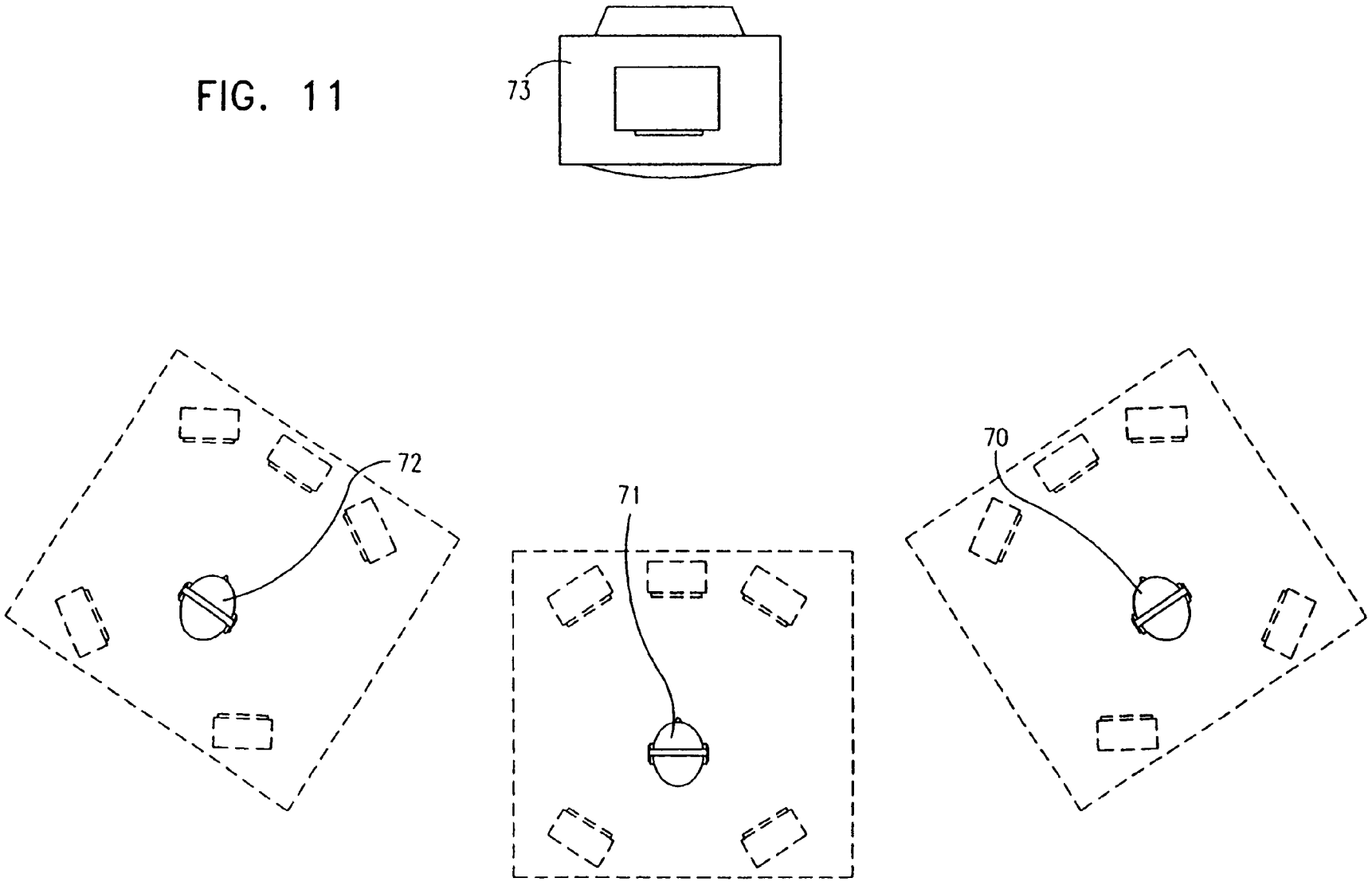
FIG. 11 illustrates how listeners seated over extensive areas of a room equipped with a surround sound headphone system constructed and operative in accordance with a preferred embodiment of the present invention all have the correct spatial illusion of the surround sound.

Several listeners 70, 71, 72, are shown in FIG. 11, sitting in a room equipped with the headphone surround sound transmission system 73. So long as they each have a headphone set, they all have the illusion of complete surround sound, as if a "center speaker" were located in the direction of the TV receiver, and four additional speakers located around each of them in perfect locations. The front virtual speakers are located 30° left and 30° right of the TV set, and the rear speakers, 30° rear left and 30° rear right. In this respect, there are A preferred embodiment of the present invention includes a headphone surround sound system having many advantages comparing to prior art speaker-based surround sound systems. These advantages are summarized as follows:

1. Surround headphones are considerably cheaper, since:
   - a There is no need to cover the room with acoustic absorbing and isolating materials.
   - b The need for expensive, space consuming speakers is eliminated.
   - c Expensive high power amplifiers are not needed.
2. In most cases, surround headphones provide the listener with improved sound quality and better immersion, since:
   - a. The acoustic environment is perfect, since there are no unwanted echoes or external noises.
   - b. Because of the low power levels involved, headphones have a considerably lower distortion level than speakers in the same quality class.
   - c. Since headphones are very close to the listener's ear, they require only a low power amplifier to drive them, and these too have a considerably lower distortion level than high power amplifiers.
   - d. In standard home theater rooms, only a small listening area in the middle of the room, called the "sweet point", is optimum for experiencing the surround sound effect fully. Using surround sound headphones, this area is much more extensive.
3. Headphones are more convenient to use, since:
   - a. Every room is suitable for watching surround sound movies, and there is no need to dedicate a special room to this purpose.
   - b. There is no need to extensively wire the listening room.
   - c. The listener can use high volume sound reproduction without bothering others.

Figure 12:
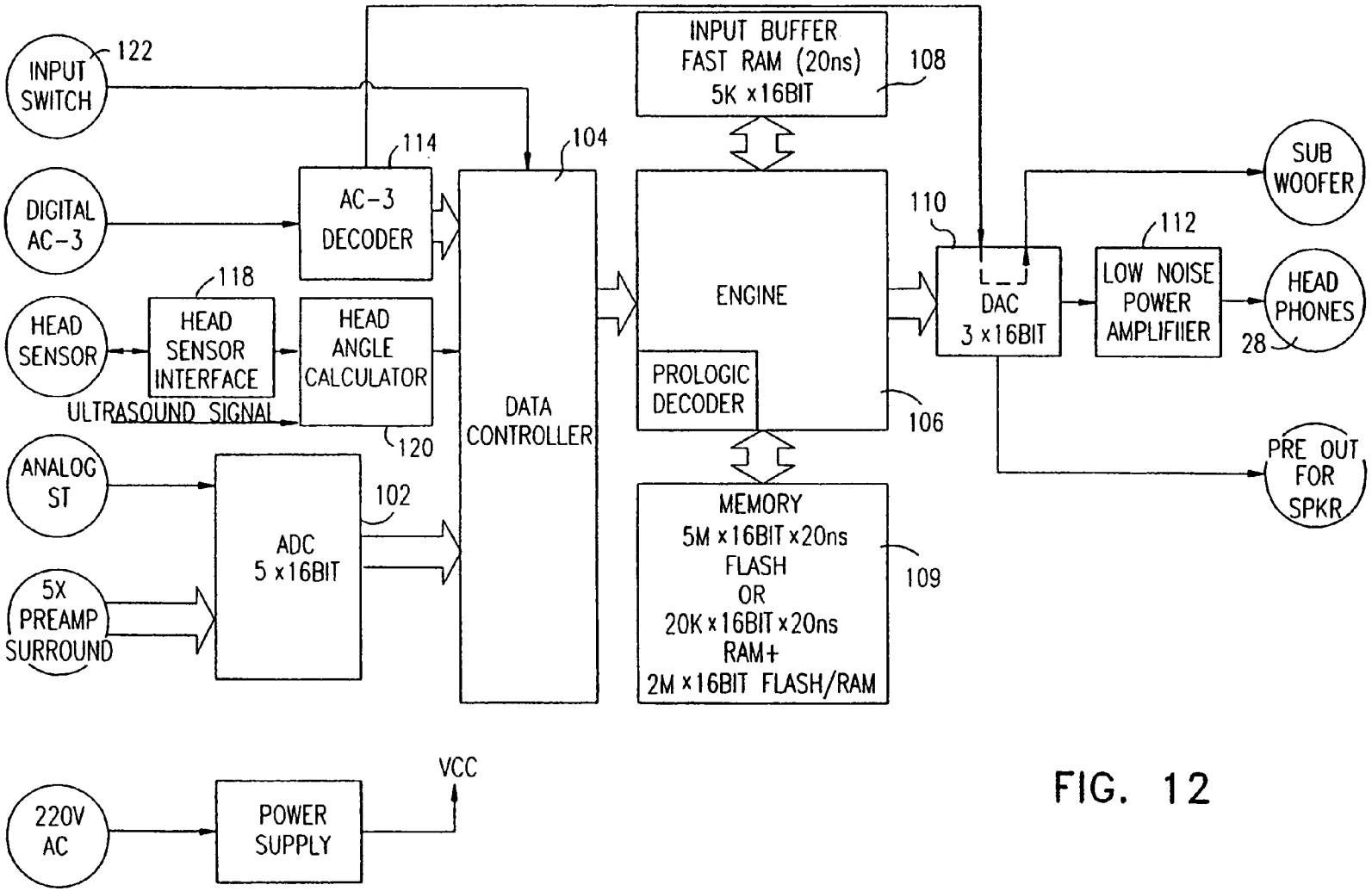
FIG. 12 is a schematic block diagram of a headphone-based surround sound system constructed and operative in accordance with another preferred embodiment of the present invention, wherein the ultrasound signal of the embodiments of FIGS. 5–11 is used as a reference signal and the audio signals are sent by wired or wireless communication to the headphones.

Reference is now made to FIG. 12 which is a schematic block diagram of a headphone-based surround sound system constructed and operative in accordance with another preferred embodiment of the present invention. In the system of FIG. 12, the ultrasound signal of the embodiments of FIGS. 5–11 is used as a reference signal and the audio signals are sent by wired or wireless communication to the headphones. Accordingly, only the audio processing portion of the system is illustrated and described with reference to FIG. 12, the ultrasound reference signal being as described hereinabove with reference to FIGS. 5–11.

An analog-to-digital converter 102 receives analog audio signals, such as from 5×PreAmp Surround or any other kind of analog stereo input. The audio signals contain, for example, the information corresponding to front right, front left, center, rear right, rear left, as described hereinabove. The signals are then sent for processing, preferably via a data controller 104, to a signal processor 106. Signal processor 106 may be packaged as an FPGA. (Optionally, data controller 104 may receive a digital audio input, such as digital AC-3 input via an AC-3 decoder 114.)

In order to process the signals, ultrasound transducer 26 (FIG. 5) sends an ultrasound reference signal to ultrasound microphones 50 and 52 (FIG. 7). A head angle calculator 120 processes arrival times of the ultrasound reference signal at each ear, so as to measure a phase difference of the reference signal as perceived by one ear in contrast to the other ear, as described hereinabove. In this manner, head angle calculator 120 calculates the azimuthal angular movement $\alpha$ and elevational angular movement $\beta$ of the head. The angular movements are sent by data controller 104 to signal processor 106 for modulating the audio input in accordance with the phase difference, in order to provide the user with the correctly directed sound, as described hereinabove.

Alternatively, a head sensor 116 may be provided, for example, mounted on surround sound headphones 28 worn by a user, which senses movement of the head of the user. For example, head sensor 116 may sense azimuthal angular movement and elevational angular movement of the head, and send the sensed data to head angle calculator 120 via a head sensor interface 118, such as an amplifier. An input switch 122 may be provided for selecting and switching between the kind of inputs available, ultrasound, or non-ultrasound.

The signal processing may be carried out by any known method, such as, but not necessarily, FIR (finite impulse response). As seen in FIG. 12, during the course of signal processing, signal processor 106 may cooperate with an input buffer 108 and a memory device 109. Input buffer 108 may be any kind of suitable buffer, such as a fast RAM (20 ns, 5K×16 bit). Signal processor 106 may comprise a decoder, such as a ProLogic Decoder, if it is required to decode the signals.

Preferably signal processor 106 cooperates with input buffer 108 in the following way. If, for example, an audio input is coming from 0° with respect to the listener (i.e., directly in front of the listener) or if it is desired to artificially mimic an audio input coming from 0°, then signal processor 106 takes the audio input for each ear at the same time from buffer 108. However, if an audio input is coming from 30° with respect to the listener, or if it is desired to artificially mimic an audio input coming from 30°, then signal processor 106 takes the audio input from buffer 108 for one ear, then waits a certain time delay corresponding to the delay that the listener would in real life sense between both ears, and only then takes the input for the other ear from buffer 108.

The processed signals are preferably output to a D-A converter 110 which sends the processed signals to headphones 28 via an LNA 112, or alternatively or additionally to a stereo speaker or subwoofer.

It is important to point out that the embodiment of FIG. 12 is different from the prior art mentioned above in the background, namely, U.S. Pat. Nos. 5,181,248, 5,452,359 and 5,495,534. In the prior art, the angular location of the head is also obtained from relative time-of-arrival measurements of an ultrasonic reference signal emitted by a transmitter located in front of the listener, by means of ultrasonic detectors located in the left and right arms of the headphone set. However, the prior art can only measure angular changes in azimuth corresponding to sideways motion of the head, in contrast, the present invention can measure and respond to any kind of angular motion, including elevation and roll and any combination of angular and linear movement of the head. The prior art cannot measure distance between ears of the listener. This is a particularly important drawback because not every listener has the same size head and so the sound effects are different for each user. In contrast, the present invention does indeed measure the distance between the two ears of the user and modifies the audio input to the two ears accordingly, as described hereinabove. In addition, the prior art does not use an input buffer as does the present invention (input buffer 108) as described hereinabove.

Figure 13:
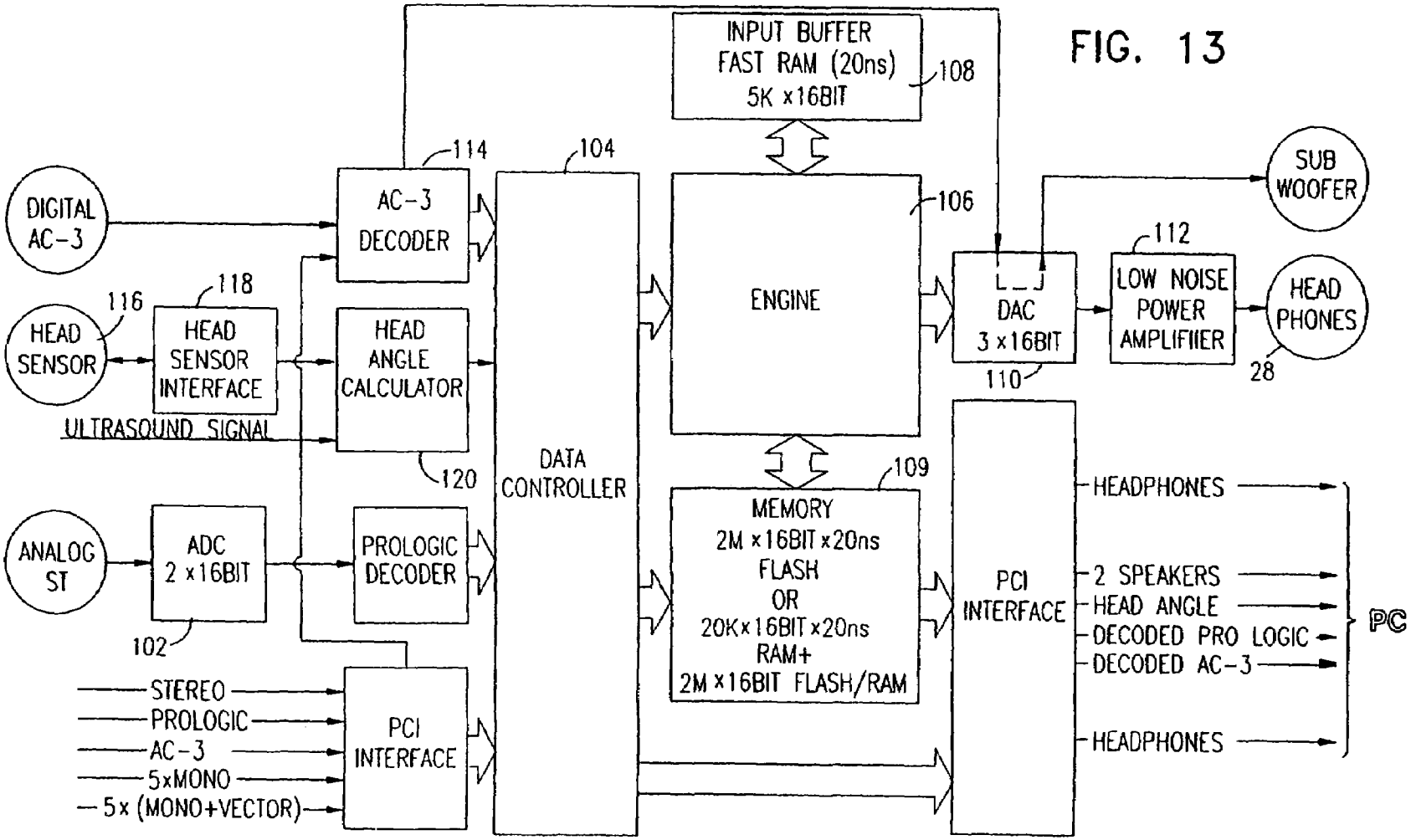
FIG. 13 is a schematic block diagram of a headphone-based surround sound system constructed and operative in accordance with yet another preferred embodiment of the present invention, this system being substantially the same as the system illustrated in FIG. 12, except that wherein the system of FIG. 12 is a stand-alone system, the system of FIG. 13 is suitable for packaging as a printed circuit board in a personal computer.

FIG. 13 is a schematic block diagram of a headphone-based surround sound system constructed and operative in accordance with yet another preferred embodiment of the present invention, this system being substantially the same as the system illustrated in FIG. 12, except that wherein the system of FIG. 12 is a stand-alone system, the system of FIG. 13 is suitable for packaging as a printed circuit board in a personal computer.

It will be appreciated by persons skilled in the art that the present invention is not limited by what has been particularly shown and described hereinabove. Rather the scope of the present invention includes both combinations and sub-combinations of the various features described hereinabove as well as variations and further developments thereof which would occur to persons skilled in the art upon reading the foregoing description and which are not in the prior art

What is claimed is:

1. A wireless headphone assembly, including:

at least two ultrasound receivers for receiving at least two ultrasound signals along at least two ultrasound channels;

at least two transducers for converting each of said ultrasound signals of said ultrasound channels to human audible signals, each of said two transducers being located on an earpiece;

wherein said at least two ultrasound receivers, called a right receiver and a left receiver, provide ultrasound signals through front and rear channels to the right and left ears of a user, wherein the right receiver provides a front right signal to the right ear and the left receiver provides a front left signal to the left ear, and wherein the right receiver provides a rear left signal to the left ear and the left receiver provides a rear right signal to the right ear, and wherein each said rear channel is accompanied by a delay operative to simulate an acoustic delay occurring between the arrival of sound from a signal source at both ears of the user.

2. A headphone system providing a simulated, multi-source sound environment, including at least one headphone assembly to be worn by a user, said assembly including:

at least two ultrasound receivers for receiving at least two ultrasound signals along at least two ultrasound channels;

at least two transducers for converting each of said ultrasound signals of said ultrasound channels to human audible signals, each of said two transducers being located on an earpiece;

wherein said at least two ultrasound receivers include a right receiver and a left receiver and provide ultrasound signals through front and rear channels to right and left ears of a user, wherein the right receiver provides a front right signal to the right ear of the user and the left receiver provides a front left signal to the left ear of the user, and wherein said right receiver provides a rear left signal to the left ear of the user and said left receiver provides a rear right signal to the right ear of the user, and wherein each said rear channel is accompanied by a delay for simulating an acoustic delay occurring between the arrival of sound from a signal source at both ears of the user;

said system further including:

at least one processor receiving a multi-source signal and modulating an ultrasound carrier along a plurality of channels in accordance with said multi-source signal, at least one transmitter for transmitting said modulated ultrasound carrier to said headphone assembly along said plurality of channels; and wherein said front channels are directly connected to said transmitter and said rear channels are connected in a cross-wise manner to said transmitter.

3. A headphone system according to claim 2, wherein the use of ultrasound for transmitting said modulated carrier to said at least one headphone assembly is operative to cause a listener using said headphone assembly to experience surround sound effects that said listener would experience if the multi-source signal were transmitted in free space as audible sound waves from suitably located sound sources.

* * * * *